US007444805B2

(12) United States Patent
Zuberi et al.

(10) Patent No.: US 7,444,805 B2
(45) Date of Patent: Nov. 4, 2008

(54) SUBSTANTIALLY FIBROUS REFRACTORY DEVICE FOR CLEANING A FLUID

(75) Inventors: Bilal Zuberi, Cambridge, MA (US); Robert G. Lachenauer, Weston, MA (US)

(73) Assignee: GEO2 Technologies, Inc., Woburn, MA (US)

( * ) Notice: Subject to any disclaimer, the term of this patent is extended or adjusted under 35 U.S.C. 154(b) by 0 days.

(21) Appl. No.: 11/322,543

(22) Filed: Dec. 30, 2005

(65) Prior Publication Data

US 2007/0151233 A1 Jul. 5, 2007

(51) Int. Cl.
*F01N 3/10* (2006.01)

(52) U.S. Cl. ..... 60/299; 60/272; 60/282; 60/322; 422/179; 422/180; 138/145; 138/149

(58) Field of Classification Search ..... 60/272, 60/274, 282, 299, 322, 323; 422/179, 180; 138/145, 149
See application file for complete search history.

(56) References Cited

U.S. PATENT DOCUMENTS

| | | | |
|---|---|---|---|
| 1,924,472 | A | 8/1933 | Miller |
| 2,120,133 | A | 6/1938 | Kohler |
| 2,390,262 | A | 12/1945 | Mazer |
| 2,847,314 | A | 8/1958 | Fisher |
| 2,930,407 | A | 3/1960 | Conley |
| 3,077,413 | A | 2/1963 | Campbell |
| 3,090,094 | A | 5/1963 | Schwartzwalder |
| 3,094,394 | A | 6/1963 | Innes |
| 3,112,184 | A | 11/1963 | Hollenbach |
| 3,141,206 | A | 7/1964 | Stephens |
| 3,159,235 | A | 12/1964 | Young |
| 3,311,481 | A | 3/1967 | Sterry |
| 3,549,473 | A | 12/1970 | LeBlanc |
| 3,702,279 | A | 11/1972 | Ardary |
| 3,752,683 | A | 8/1973 | Hawthorne |
| 3,788,935 | A | 1/1974 | Shyne |
| 3,795,524 | A | 3/1974 | Sowman |
| 3,827,238 | A | 8/1974 | Hayashi |
| 3,869,267 | A | 3/1975 | Gaylor |
| 3,916,057 | A | 10/1975 | Hatch |
| 3,920,404 | A | 11/1975 | Gandhi |
| 3,927,152 | A | 12/1975 | Kyrias |
| 3,935,060 | A | 1/1976 | Blome |

(Continued)

FOREIGN PATENT DOCUMENTS

| | | |
|---|---|---|
| DE | 3931976 | 8/2001 |

(Continued)

OTHER PUBLICATIONS

Anderson, Ultra Thin Wall Mat Design and Optimization with Hybrid Mats, SAE Technical Paper Series 2004-01-0145, Mar. 2004.

(Continued)

*Primary Examiner*—Binh Q Tran

(57) ABSTRACT

The present invention relates to an exhaust system conduit, including a generally cylindrical outer portion and a generally cylindrical inner portion disposed within the generally cylindrical outer portion and defining a generally cylindrical fluid-flow path. The generally cylindrical inner portion further includes a substantially fibrous porous nonwoven refractory monolith and a catalyst material at least partially coating the monolith.

6 Claims, 6 Drawing Sheets

U.S. PATENT DOCUMENTS

| | | | | | |
|---|---|---|---|---|---|
| 3,945,803 | A | | 3/1976 | Musall | |
| 3,952,083 | A | | 4/1976 | Fletcher | |
| 3,953,646 | A | | 4/1976 | Fletcher | |
| 3,957,445 | A | | 5/1976 | Foster | |
| 3,969,095 | A | | 7/1976 | Kurahashi | |
| 3,978,567 | A | | 9/1976 | Vroman | |
| 4,001,996 | A | | 1/1977 | Byrd, Jr. | |
| 4,004,649 | A | | 1/1977 | Shimada | |
| 4,007,539 | A | | 2/1977 | Nishio | |
| 4,012,485 | A | | 3/1977 | Meguerian | |
| 4,014,372 | A | | 3/1977 | Dichiara | |
| 4,020,896 | A | | 5/1977 | Mold | |
| 4,038,175 | A | | 7/1977 | Bhasin | |
| 4,039,292 | A | | 8/1977 | Morini | |
| 4,041,199 | A | | 8/1977 | Cartwright | |
| 4,041,592 | A | | 8/1977 | Kelm | |
| 4,056,654 | A | | 11/1977 | Kompanek | |
| 4,065,046 | A | | 12/1977 | Roberts | |
| 4,092,194 | A | | 5/1978 | Green | |
| 4,094,644 | A | | 6/1978 | Wagner | |
| 4,094,645 | A | | 6/1978 | Bailey | |
| 4,098,580 | A | | 7/1978 | Shimizu | |
| 4,148,962 | A | | 4/1979 | Frosch | |
| 4,156,533 | A | | 5/1979 | Close | |
| 4,192,402 | A | | 3/1980 | Nakagawa | |
| 4,206,177 | A | | 6/1980 | Otsubo | |
| 4,208,374 | A | | 6/1980 | Foster | |
| 4,239,733 | A | | 12/1980 | Foster | |
| 4,276,071 | A | | 6/1981 | Outland | |
| 4,290,501 | A | | 9/1981 | Tanaka | |
| 4,297,328 | A | | 10/1981 | Ritscher | |
| 4,319,556 | A | | 3/1982 | Schwartz | |
| 4,324,572 | A | | 4/1982 | Erdmannsdorfer | |
| 4,329,162 | A | | 5/1982 | Pitcher, Jr. | |
| 4,335,023 | A | | 6/1982 | Dettling | |
| 4,338,368 | A | | 7/1982 | Lovelace | |
| 4,343,074 | A | | 8/1982 | Bailey | |
| 4,345,430 | A | | 8/1982 | Pallo | |
| 4,348,362 | A | | 9/1982 | Foss | |
| 4,349,055 | A | | 9/1982 | Dichiara | |
| 4,358,480 | A | | 11/1982 | Ecord | |
| 4,379,109 | A | | 4/1983 | Simpson | |
| 4,398,931 | A | | 8/1983 | Shevlin | |
| 4,404,992 | A | | 9/1983 | Sasaki | |
| 4,410,427 | A | | 10/1983 | Wydeven | |
| 4,415,342 | A | | 11/1983 | Foss | |
| 4,417,908 | A | | 11/1983 | Pitcher, Jr. | |
| 4,427,418 | A | | 1/1984 | Kogiso | |
| 4,436,538 | A | * | 3/1984 | Tomita et al. | 55/482 |
| 4,456,457 | A | | 6/1984 | Nozawa | |
| 4,457,895 | A | | 7/1984 | Prigent | |
| 4,483,108 | A | | 11/1984 | Howard | |
| 4,495,399 | A | | 1/1985 | Cann | |
| 4,508,256 | A | | 4/1985 | Radel | |
| 4,529,718 | A | | 7/1985 | Dupin | |
| 4,550,034 | A | | 10/1985 | Shimrock | |
| 4,554,195 | A | | 11/1985 | Ormiston | |
| 4,557,773 | A | | 12/1985 | Bonzo | |
| 4,584,003 | A | | 4/1986 | Oda | |
| 4,601,868 | A | | 7/1986 | Radel | |
| 4,608,108 | A | | 8/1986 | Goll | |
| 4,609,563 | A | | 9/1986 | Shimrock | |
| 4,647,477 | A | | 3/1987 | DeLuca | |
| 4,650,775 | A | | 3/1987 | Hill | |
| 4,671,911 | A | | 6/1987 | Garnier | |
| 4,682,470 | A | | 7/1987 | Shaff | |
| 4,686,128 | A | | 8/1987 | Gentilman | |
| 4,696,711 | A | | 9/1987 | Greszczuk | |
| 4,710,487 | A | | 12/1987 | Koch | |
| 4,711,009 | A | | 12/1987 | Cornelison | |
| 4,722,920 | A | | 2/1988 | Kimura | |
| 4,732,593 | A | | 3/1988 | Kondo | |
| 4,732,879 | A | | 3/1988 | Kalinowski | |
| 4,735,756 | A | | 4/1988 | Rausch | |
| 4,737,326 | A | | 4/1988 | Wirth | |
| 4,749,671 | A | | 6/1988 | Saito et al. | |
| 4,761,323 | A | | 8/1988 | Muhlratzer | |
| 4,818,625 | A | | 4/1989 | Lavendel | |
| 4,828,774 | A | | 5/1989 | Andersson | |
| 4,847,506 | A | | 7/1989 | Archer | |
| 4,849,399 | A | | 7/1989 | Joy, III | |
| 4,858,117 | A | | 8/1989 | Dichiara | |
| 4,863,700 | A | * | 9/1989 | Ten Eyck | 422/179 |
| 4,865,877 | A | | 9/1989 | Yamaguchi | |
| 4,885,679 | A | | 12/1989 | Webster, Jr. | |
| 4,890,285 | A | | 12/1989 | Dichiara | |
| 4,894,070 | A | | 1/1990 | Keidel | |
| 4,915,981 | A | | 4/1990 | Traskos | |
| 4,916,897 | A | | 4/1990 | Hayashi | |
| 4,923,487 | A | * | 5/1990 | Bogart et al. | 55/482 |
| 4,925,561 | A | | 5/1990 | Ishii | |
| 4,928,645 | A | | 5/1990 | Berneburg | |
| 4,928,714 | A | | 5/1990 | Shannon | |
| 4,929,429 | A | | 5/1990 | Merry | |
| 4,934,142 | A | | 6/1990 | Hayashi | |
| 4,935,178 | A | | 6/1990 | Esposito | |
| 4,940,523 | A | | 7/1990 | Takeshima | |
| 4,942,020 | A | | 7/1990 | Whittenberger | |
| 4,952,896 | A | | 8/1990 | Dawson, Jr. | |
| 4,955,164 | A | | 9/1990 | Hashish | |
| 4,957,773 | A | | 9/1990 | Spencer | |
| 4,968,383 | A | | 11/1990 | Volkmann | |
| 4,970,035 | A | | 11/1990 | Baarsch | |
| 4,976,760 | A | | 12/1990 | Helferich | |
| 4,976,929 | A | | 12/1990 | Cornelison | |
| 4,988,290 | A | | 1/1991 | Forster | |
| 5,006,021 | A | | 4/1991 | Wheetley | |
| 5,007,475 | A | | 4/1991 | Kennedy | |
| 5,008,086 | A | | 4/1991 | Merry | |
| 5,015,610 | A | | 5/1991 | Dwivedi | |
| 5,021,369 | A | | 6/1991 | Ackerman | |
| 5,024,979 | A | | 6/1991 | Debaig-Valade | |
| 5,028,397 | A | | 7/1991 | Merry | |
| 5,043,244 | A | | 8/1991 | Cairncross | |
| 5,053,062 | A | | 10/1991 | Barris | |
| 5,062,911 | A | | 11/1991 | Hampton | |
| 5,063,029 | A | | 11/1991 | Mizuno | |
| 5,065,757 | A | | 11/1991 | Dragisic | |
| 5,066,432 | A | | 11/1991 | Gabathuler | |
| 5,070,591 | A | | 12/1991 | Quick | |
| 5,075,160 | A | | 12/1991 | Stinton | |
| 5,079,082 | A | | 1/1992 | Leiser | |
| 5,087,272 | A | | 2/1992 | Nixdorf | |
| 5,089,236 | A | | 2/1992 | Clerc | |
| 5,106,397 | A | | 4/1992 | Jaroszczyk | |
| 5,114,901 | A | | 5/1992 | Tsang | |
| 5,117,939 | A | | 6/1992 | Noguchi | |
| 5,124,302 | A | | 6/1992 | Lachman | |
| 5,151,819 | A | | 9/1992 | Stephens | |
| 5,154,373 | A | | 10/1992 | Scott | |
| 5,154,894 | A | | 10/1992 | MacFarlane | |
| 5,154,901 | A | | 10/1992 | Yoshida | |
| 5,163,289 | A | * | 11/1992 | Bainbridge | 60/274 |
| 5,167,934 | A | | 12/1992 | Wolf | |
| 5,168,085 | A | | 12/1992 | Addiego | |
| 5,171,341 | A | | 12/1992 | Merry | |
| 5,173,349 | A | | 12/1992 | Yavuz | |
| 5,174,969 | A | | 12/1992 | Fischer | |
| 5,179,061 | A | | 1/1993 | Haerle | |
| 5,180,409 | A | | 1/1993 | Fischer | |
| 5,186,903 | A | | 2/1993 | Cornwell | |
| 5,194,078 | A | | 3/1993 | Yonemura | |
| 5,195,319 | A | | 3/1993 | Stobbe | |
| 5,196,120 | A | | 3/1993 | White | |

5,210,062 A 5/1993 Narula
5,231,409 A 7/1993 Astier
5,232,671 A 8/1993 Brunson
5,238,386 A 8/1993 Cunningham
5,244,852 A 9/1993 Lachman
5,248,481 A 9/1993 Bloom
5,248,482 A 9/1993 Bloom
5,250,094 A 10/1993 Chung
5,258,150 A 11/1993 Merckel
5,258,164 A 11/1993 Bloom
5,260,125 A 11/1993 Copes
5,262,129 A 11/1993 Terada
5,266,548 A 11/1993 Koradia
5,270,551 A 12/1993 Kamimura
5,271,906 A 12/1993 Yuuki
5,272,125 A 12/1993 Weible
5,279,737 A 1/1994 Sekhar
5,290,350 A 3/1994 Besnard
5,293,743 A * 3/1994 Usleman et al. ..... 60/299
5,294,409 A 3/1994 Cohen
5,294,411 A 3/1994 Breuer
5,298,046 A 3/1994 Peisert
5,303,547 A 4/1994 Mieville
5,304,520 A 4/1994 Dwivedi
5,334,570 A 8/1994 Beauseigneur
5,338,903 A 8/1994 Winberg
5,339,629 A 8/1994 Winberg
5,376,598 A 12/1994 Preedy
5,380,580 A 1/1995 Rogers
5,380,621 A 1/1995 Dichiara
5,386,696 A * 2/1995 Prigent et al. ..... 60/300
5,391,428 A 2/1995 Zender
5,393,499 A 2/1995 Bagley
5,401,614 A 3/1995 Dichiara
5,408,827 A 4/1995 Holtermann
5,409,669 A 4/1995 Smith
5,429,780 A 7/1995 Prin
5,436,216 A 7/1995 Toyao
5,449,654 A 9/1995 Prin
5,451,444 A 9/1995 DeLiso
5,453,116 A 9/1995 Fischer
5,455,594 A 10/1995 Blasing
5,456,965 A 10/1995 Machida
5,458,944 A 10/1995 Austin
5,463,206 A 10/1995 Abe
5,466,917 A 11/1995 Matsuki
5,482,538 A 1/1996 Becker
5,482,817 A 1/1996 Dichiara
5,486,399 A 1/1996 Brydon
5,487,865 A 1/1996 Hampton
5,501,842 A 3/1996 Rajnik
5,504,281 A 4/1996 Whitney
5,511,747 A 4/1996 Parrot
5,516,580 A 5/1996 Frenette
5,519,191 A 5/1996 Ketcham
5,523,059 A 6/1996 Langer
5,526,462 A 6/1996 Kondo
5,536,562 A 7/1996 Tran
5,540,981 A 7/1996 Gallagher
5,551,239 A 9/1996 Feeley
5,552,360 A 9/1996 Farrauto
5,553,455 A 9/1996 Craig
5,554,485 A 9/1996 Dichiara
5,567,536 A 10/1996 Lintz
5,569,441 A 10/1996 Engler et al.
5,582,805 A 12/1996 Yoshizaki
5,589,143 A 12/1996 Mori
5,593,647 A 1/1997 Kirby
5,599,510 A 2/1997 Kaminsky
5,601,259 A 2/1997 Dichiara
5,611,832 A 3/1997 Suzuki
5,614,155 A 3/1997 Abe
5,618,500 A 4/1997 Wang
5,626,951 A 5/1997 Hogenson
5,629,067 A 5/1997 Kotani
5,629,186 A 5/1997 Yasukawa
5,632,320 A 5/1997 Atmur
5,637,399 A 6/1997 Yoshikawa
5,656,048 A 8/1997 Smith
5,660,778 A 8/1997 Ketcham
5,666,804 A 9/1997 Sekiya
5,674,802 A 10/1997 Sheppard
5,686,039 A 11/1997 Merry
5,686,368 A 11/1997 Wong
5,687,046 A 11/1997 Mathews
5,687,787 A 11/1997 Atmur
5,691,736 A 11/1997 Hunn
5,692,373 A 12/1997 Atmur
5,702,494 A 12/1997 Tompkins
5,702,761 A 12/1997 Dichiara, Jr.
5,705,118 A 1/1998 Hayes
5,705,129 A 1/1998 Takahashi
5,705,444 A 1/1998 Tompkins
5,721,188 A 2/1998 Sung
5,730,096 A 3/1998 Atmur
5,732,555 A 3/1998 Gracyalny
5,736,107 A 4/1998 Inomata
5,742,254 A 4/1998 Bassaler
5,744,763 A 4/1998 Iwasa
5,749,223 A 5/1998 Kreucher
5,750,026 A 5/1998 Gadkaree
5,766,458 A 6/1998 Sekhar
5,772,154 A 6/1998 Stewart
5,773,143 A 6/1998 Vermilion
5,780,126 A 7/1998 Smith
5,783,515 A 7/1998 Sakurai
5,795,456 A 8/1998 Friedman
5,801,806 A 9/1998 Dichiara
5,814,397 A 9/1998 Cagliostro
5,827,577 A 10/1998 Spencer
5,830,250 A 11/1998 Shirk
5,842,342 A 12/1998 Strasser
5,844,200 A 12/1998 Leader
5,849,375 A 12/1998 Smith
5,849,406 A 12/1998 Daws
5,851,647 A 12/1998 Foster
5,853,675 A 12/1998 Howorth
5,853,684 A 12/1998 Fang
5,856,263 A 1/1999 Bhasin
5,866,210 A 2/1999 Rosynsky
5,872,067 A 2/1999 Meng
5,876,529 A 3/1999 Grant
5,879,640 A 3/1999 Atmur
5,882,608 A 3/1999 Sanocki
5,883,021 A 3/1999 Beer
5,884,864 A 3/1999 Sunne
5,907,273 A 5/1999 Ross, Jr.
5,910,095 A 6/1999 Strasser
5,925,156 A 7/1999 Motoki
5,928,448 A 7/1999 Daws
5,928,775 A 7/1999 Dichiara, Jr.
5,932,496 A 8/1999 Morris
5,939,141 A 8/1999 Cagliostro
5,943,857 A 8/1999 Ansell
5,948,146 A 9/1999 Thomaides
5,948,257 A 9/1999 Custer
5,955,177 A 9/1999 Sanocki
5,972,810 A 10/1999 Gabrisch
5,976,997 A 11/1999 Meaney
5,980,837 A 11/1999 Umin
5,980,980 A 11/1999 Dichiara
5,983,628 A 11/1999 Borroni-Bird
5,987,882 A 11/1999 Voss
5,987,885 A 11/1999 Kizer
5,989,476 A 11/1999 Lockard
6,013,599 A 1/2000 Manson 6,019,946 A 2/2000 Castillo
6,029,443 A 2/2000 Hirota
6,051,193 A 4/2000 Langer
6,058,918 A 5/2000 Noetzlin
6,074,699 A 6/2000 Dichiara, Jr.
6,077,600 A 6/2000 Atmur
6,099,671 A 8/2000 Pearson
6,101,714 A 8/2000 Schmitt
6,112,746 A 9/2000 Kwok
6,121,169 A 9/2000 Carpenter
6,152,722 A 11/2000 Sick
6,153,291 A 11/2000 Strasser
6,156,698 A 12/2000 Iida
6,157,349 A 12/2000 Crouch
6,166,283 A 12/2000 Bharadwaj
6,171,556 B1 1/2001 Burk
6,174,565 B1 1/2001 Daws
6,197,180 B1 3/2001 Kelly
6,200,483 B1 3/2001 Cutler
6,200,523 B1 3/2001 Quick
6,200,538 B1 3/2001 Bruck
6,200,706 B1 3/2001 Ashida
6,210,786 B1 4/2001 Atmur
6,214,072 B1 4/2001 Kappeler
6,227,699 B1 5/2001 Wight, Jr.
6,228,117 B1 5/2001 De Bruijn
6,228,478 B1 5/2001 Kliwer
6,237,587 B1 5/2001 Sparling
6,238,467 B1 5/2001 Azarian
6,238,618 B1 5/2001 Brundage
6,242,712 B1 6/2001 Prust
6,245,301 B1 * 6/2001 Stroom et al. ..... 422/179
6,247,304 B1 6/2001 Kim
6,248,684 B1 6/2001 Yavuz
6,248,689 B1 6/2001 Manson
6,251,498 B1 6/2001 Fukushima
6,270,216 B1 8/2001 Dichiara
6,277,016 B1 8/2001 Koide
6,279,857 B1 8/2001 Roth
6,296,667 B1 10/2001 Johnson
6,324,758 B1 12/2001 Huang
6,340,360 B1 1/2002 Lyles
6,355,591 B1 3/2002 Kuvettu
6,365,092 B1 4/2002 Backa
6,393,835 B1 5/2002 Stoll
6,397,603 B1 6/2002 Edmondson
6,410,161 B1 6/2002 Li
6,419,189 B1 7/2002 Dichiara, Jr.
6,419,890 B1 7/2002 Li
6,440,192 B2 8/2002 Guerin
6,441,341 B1 8/2002 Steibel
6,441,793 B1 8/2002 Shea
6,444,006 B1 9/2002 Haberkamp
6,444,271 B2 9/2002 Wittenauer
6,449,947 B1 9/2002 Liu
6,453,937 B1 9/2002 Tobias
6,454,622 B2 9/2002 Mashiko
6,455,122 B1 9/2002 Igashira
6,465,742 B1 10/2002 Hiraoka
6,479,104 B1 11/2002 Dichiara, Jr.
6,484,723 B2 11/2002 Haas
6,489,001 B1 12/2002 Cazzato
6,494,936 B1 12/2002 Peacock
6,494,979 B1 12/2002 Dichiara, Jr.
6,495,168 B2 12/2002 West
6,495,207 B1 12/2002 Prociw
6,497,390 B1 12/2002 Fischer
6,502,289 B1 1/2003 Kane
6,509,088 B2 1/2003 Baxter
6,511,355 B1 1/2003 Woodward
6,513,526 B2 2/2003 Kwok
6,514,040 B2 2/2003 Lewis
6,521,321 B2 2/2003 Kahlbaugh
6,531,078 B2 3/2003 Laine
6,531,425 B2 3/2003 Golden
6,533,930 B1 3/2003 Kool
6,533,976 B1 3/2003 Strasser
6,548,446 B1 4/2003 Koermer
6,550,573 B2 4/2003 Wagner
6,551,386 B2 4/2003 Weiler
6,551,951 B1 4/2003 Fay
6,555,211 B2 4/2003 Moody
6,558,785 B1 5/2003 Rawal
6,559,094 B1 5/2003 Korotkikh
6,584,768 B1 7/2003 Hecker
6,601,385 B2 8/2003 Verdegan
6,607,851 B2 8/2003 Dichiara, Jr.
6,607,998 B1 8/2003 Lambert
6,613,255 B2 9/2003 Dichiara, Jr.
6,622,482 B2 9/2003 Knight
6,630,115 B1 10/2003 Kaneeda
6,632,110 B2 10/2003 Kato
6,632,412 B2 10/2003 Peltola
6,632,540 B2 10/2003 Dichiara, Jr.
6,641,795 B2 11/2003 Abe
6,652,446 B1 11/2003 Bove
6,652,950 B2 11/2003 Barney
6,660,115 B2 12/2003 Butler
6,663,051 B2 12/2003 Okuyama
6,663,839 B2 12/2003 Platvoet
6,669,265 B2 12/2003 Tilton
6,669,913 B1 12/2003 Haberkamp
6,673,136 B2 1/2004 Gillingham
6,676,077 B1 1/2004 Dichiara, Jr.
6,676,745 B2 1/2004 Merkley
6,698,193 B2 3/2004 Duerr
6,699,342 B2 3/2004 Dichiara, Jr.
6,699,555 B2 3/2004 Dichiara, Jr.
6,712,318 B2 3/2004 Gubert
6,726,884 B1 * 4/2004 Dillon et al. ..... 422/179
6,770,584 B2 8/2004 Barney
2001/0002287 A1 5/2001 Kar
2001/0037729 A1 11/2001 Machida
2001/0043891 A1 11/2001 Adiletta
2002/0004450 A1 1/2002 Gaffney
2002/0087042 A1 7/2002 Schmidt
2002/0149128 A1 10/2002 Dichiara, Jr.
2002/0150526 A1 10/2002 Hopkins
2002/0157358 A1 10/2002 Noda
2002/0192512 A1 12/2002 Dichiara, Jr.
2003/0003232 A1 1/2003 Rosynsky
2003/0022783 A1 1/2003 Dichiara, Jr.
2003/0032545 A1 2/2003 Dichiara, Jr.
2003/0036477 A1 2/2003 Nordquist
2003/0068153 A1 4/2003 Suzuki
2003/0082414 A1 5/2003 Dichiara, Jr.
2003/0115859 A1 6/2003 Deeba
2003/0138585 A1 7/2003 Dichiara, Jr.
2003/0152432 A1 8/2003 Meece
2003/0165638 A1 9/2003 Louks
2003/0183008 A1 10/2003 Bang
2003/0205310 A1 11/2003 Dichiara, Jr.
2004/0001781 A1 1/2004 Kumar
2004/0001782 A1 1/2004 Kumar
2004/0028587 A1 2/2004 Twigg
2004/0031643 A1 2/2004 Wagner
2004/0056151 A1 3/2004 Dichiara, Jr.
2004/0057879 A1 * 3/2004 Aizawa et al. ..... 422/179
2004/0091699 A1 5/2004 Denham
2004/0091736 A1 5/2004 Dichiara, Jr.
2004/0096619 A1 5/2004 Dichiara, Jr.
2004/0132607 A1 7/2004 Wood 2004/0176246 A1 9/2004 Shirk

FOREIGN PATENT DOCUMENTS

| | | | |
|---|---|---|---|
| EP | 0044716 | 1/1982 | |
| EP | 0047525 | 3/1982 | |
| EP | 0187256 | 7/1986 | |
| EP | 0278597 | 8/1988 | |
| EP | 0244109 | 9/1990 | |
| EP | 0412315 | 2/1991 | |
| EP | 0124863 | 4/1991 | |
| EP | 0421159 | 4/1991 | |
| EP | 0433582 | 6/1991 | |
| EP | 0202733 | 7/1991 | |
| EP | 0441401 | 8/1991 | |
| EP | 0251150 | 12/1991 | |
| EP | 0471590 | 2/1992 | |
| EP | 0500154 | 8/1992 | |
| EP | 0554104 | 8/1993 | |
| EP | 0561019 | 9/1993 | |
| EP | 0236071 | 10/1993 | |
| EP | 0345795 | 11/1993 | |
| EP | 0570698 | 11/1993 | |
| EP | 0588182 | 3/1994 | |
| EP | 0668252 | 2/1995 | |
| EP | 0431648 | 3/1995 | |
| EP | 0648535 | 4/1995 | |
| EP | 0380634 | 8/1995 | |
| EP | 0600971 | 11/1995 | |
| EP | 0704241 | 4/1996 | |
| EP | 0618353 | 7/1996 | |
| EP | 0727567 | 8/1996 | |
| EP | 0734757 | 10/1996 | |
| EP | 0737859 | 10/1996 | |
| EP | 0750971 | 1/1997 | |
| EP | 0769822 | 4/1997 | |
| EP | 0692995 | 7/1997 | |
| EP | 0790216 | 8/1997 | |
| EP | 0819459 | 1/1998 | |
| EP | 0599595 | 4/1998 | |
| EP | 0473715 | 8/1998 | |
| EP | 0884459 | 12/1998 | |
| EP | 0705134 | 4/1999 | |
| EP | 0830201 | 1/2000 | |
| EP | 1052010 | 11/2000 | |
| EP | 0835368 | 1/2001 | |
| EP | 0835367 | 3/2001 | |
| EP | 1085352 | 3/2001 | |
| EP | 1125704 | 8/2001 | |
| EP | 1163970 | 12/2001 | |
| EP | 1180390 | 2/2002 | |
| EP | 0906496 | 3/2002 | |
| EP | 0958874 | 5/2002 | |
| EP | 1205228 | 5/2002 | |
| EP | 0856645 | 7/2002 | |
| EP | 1254715 | 11/2002 | |
| EP | 1222661 | 5/2003 | |
| EP | 1326012 | 7/2003 | |
| EP | 1331118 | 7/2003 | |
| EP | 0912820 | 8/2003 | |
| EP | 1342889 | 9/2003 | |
| EP | 1032755 | 11/2003 | |
| EP | 1366801 | 12/2003 | |
| JP | 02001193442 A * | 7/2001 | ..... 60/299 |
| WO | WO9303262 | 2/1993 | |
| WO | WO9416134 | 7/1994 | |
| WO | WO9620787 | 7/1996 | |
| WO | WO9701599 | 1/1997 | |
| WO | WO9927206 | 6/1999 | |
| WO | WO9955459 | 11/1999 | |
| WO | WO0008315 | 2/2000 | |
| WO | WO0021903 | 4/2000 | |
| WO | WO0070915 | 11/2000 | |
| WO | WO0071863 | 11/2000 | |
| WO | WO0154801 | 8/2001 | |
| WO | WO0172663 | 10/2001 | |
| WO | WO0173126 | 10/2001 | |
| WO | WO0183956 | 11/2001 | |
| WO | WO0194760 | 12/2001 | |
| WO | WO0197952 | 12/2001 | |
| WO | WO2003053542 | 7/2003 | |
| WO | WO2003068362 | 8/2003 | |
| WO | WO2003069595 | 8/2003 | |
| WO | WO2004011783 | 2/2004 | |
| WO | WO2004011785 | 2/2004 | |
| WO | WO2004001807 | 3/2004 | |

OTHER PUBLICATIONS

Ogunwumi et al., Aluminum Titanate Compositions for Diesel Particulate Filters, SAE Technical Paper Series 2005-01-0583, Apr. 2005.

Cutler et al., A New High Temperature Ceramic Material for Diesel Particulate Filter Applications, SAE Technical Paper Series 2001-01-2844, Oct. 2000.

Chant et al., Aluminum Clad Ferritic Stainless Steel Foil for Metallic Catalytic Converter Substrate Applications, SAE Technical Paper Series 960556, Feb. 1996.

Brogan et al., Recent Progress in NOx Trap Technology, SAE Technical Paper Series 980933, Feb. 1998.

Gulati, Physical Durability of Thin Wall Ceramic Substrates, SAE Technical Paper Series 982635, Oct. 1998.

Dou et al., Investigation of NOx Adsorber Catalyst Deactivation, SAE Technical Paper Series 982594, Oct. 1998.

Aaronson et al., Diesel Odor and the Formation of Aromatic Hydrocarbons During the Heterogeneous Combustion of Pure Cetane in a Single-Cylinder Diesel Engine, Thirteenth Symposium on Combustion, Aug. 1970.

Bascom et al., Design Factors that Affect Diesel Emissions.

Cooper et al., Role of NO in Diesel Particulate Emission Control.

Ilurn, Air Pollution and the Compression-Ignition Engine, Twelfth Symposium on Combustion, Jul. 1968.

Cooke, Inorganic Fibers—A Literature Review, Journal of the American Ceramic Society, 1991.

Fernando et al., Improving an Alumina Fiber Filter Membrane for Hot Gas Filtration Using an Acid Phosphate Binder, Journal of Materials Science, 2001.

Wall-Flow Monoliths, www.DieselNet.com, 2004.

Diesel Filter Materials, www.DieselNet.com, 2003.

Ceramic Catalyst Substrates, www.DieselNet.com, 1997.

Khair, Air-to-Air Intercooling of the Ford 7.8L Mid-Range Truck Diesel Engine, SAE Technical Paper Series 870534, Feb. 1987.

Khan et al., Progress of Diesel Combustion Research, CIMAC 9th International Congress on combustion Engines, 1971.

Lavoie et al., Experimental and Theoretical Study of Nitric Oxide Formation in Internal Combustion Engines, Combustion Science and Technology, 1970.

McCarthy, Diesel Fuel Property Effects on Exhaust Emissions from a Heavy Duty Diesel Engine that Meets 1994 Emissions Requirements, SAE Technical Paper Series 922267, Oct. 1992.

Merrion, Effect of Design Revisions on Two Stroke Cycle Diesel Engine Exhaust.

Nakatsuji et al., Highly Durable NOx Reduction System and Catalysts for NOx Storage Reduction System, SAE Technical Paper Series 980932, Feb. 1998.

Miyamoto et al., Description of Diesel Emissions by Individual Fuel Properties, SAE Technical Paper Series 922221, Oct. 1992.

Komiyama et al., Predicting NOx Emissions and Effects of Exhaust Gas Recirculation in Spark-Ignition Engines, Society of Automotive Engineers, May 1973.

Marshall et al., Factors Influencing Diesel Emissions, Society of Automotive Engineers, Inc., Aug. 1968.

Newhall et al., Direct Spectroscopic Determination of Nitric Oxide in Reciprocating Engine Cylinders, Society of Automotive Engineers, Inc., Jan. 1967.

Olson, Diesel Emission Control Devices—Design Factors Affecting Mounting Mat Selection, SAE Technical Paper Series 2004-01-1420, Mar. 2004.
Page, Optimization of the Air/Fuel Ratio for Improved Engine Performance and Reduced Emissions, SAE Technical Paper Series 961714, Aug. 1995.
Perez et al., Exhaust Emission Characteristics of Precombustion Chamber Engines.
Tuomola et al., A New Metallic Catalyst, SAE Technical paper Series 2002-01-0357, Mar. 2002.
Pischinger, The Diesel Engine for Cars—Is There a Future?, ICE Fall Technical Conference, 1996.
Wright et al., A Novel Electrostatic Method of Ultrafine PM Control Suitable for Low Exhaust Temperature Applications, SAE Technical Paper Series 2003-01-0771, Mar. 2003.
Watts et al., Air Motion and Fuel Distribution Requirements in High-Speed Direct Injection Diesel Engines, The Institution of Mechanical Engineers, 1969-70.
Ullman et al., Effects of Fuel Aromatics, Cetane Number, and Cetane Improver on Emissions from a 1991 Prototype Heavy-Duty Diesel Engine, SAE Technical Paper Series 902171, Oct. 1990.

* cited by examiner

SUBSTANTIALLY FIBROUS REFRACTORY DEVICE FOR CLEANING A FLUID

CROSS REFERENCE TO RELATED APPLICATIONS

This application is related to U.S. patent application Ser. No. 10/833,298, filed Apr. 28, 2004, and entitled "Nonwoven Composites and Related Products and Processes", which is a continuation-in-part of U.S. patent application Ser. No. 10/281,179, filed Oct. 28, 2002, and entitled "Ceramic Exhaust Filter", now U.S. Pat. No. 6,946,013, issued Sep. 20, 2005, both of which are incorporated herein as if set forth in their entirety.

BACKGROUND

1. Field

The present invention relates generally to a catalytic device for cleaning and thermally managing a contaminated fluid, and more particularly to a catalytic device for use on a vehicle exhaust system.

2. Description of Related Art

Exhaust systems perform several functions for a modern engine. For example, the exhaust system is expected to manage heat, reduce pollutants, control noise, and sometimes filter particulate matter. Generally, these individual functions are performed by separate and distinct components. Take, for example, the exhaust system of a typical small gasoline engine. The small engine exhaust system may use a set of heat exchangers or external baffles to capture and dissipate heat and/or heat shields to protect the vehicle and/or the operator from excessive heat. A separate muffler may be coupled to the exhaust outlet to control noise, while a catalytic converter assembly may be placed in the exhaust path to reduce non-particulate pollutants. Although particulates may not generally be a concern in the small gasoline engine, some applications may benefit from the use of a separate particulate filter. Due to space limitations, costs, and engine performance issues, it is not always possible to include separate devices to perform all the desired functions, thereby resulting in an exhaust system that is undesirably hot, polluting, or noisy.

Known exhaust systems are often arranged with catalytic devices to support non-particulate emission control. Due to the physical size and reactivity requirements for these devices, their placement options are quite limited. Each device that must be placed adds additional design time, cost, and consumes valuable and limited space in the product. As emission requirements tighten, it is likely that more catalytic effect will be required, as well as further particulate control. In general, there has been a trend to place catalytic converters closer to the engine manifold in order to improve the transfer of heat to the catalysts and to decrease the time it takes for the catalysts to reach the operating or 'light off' temperature. However, it is not always possible to find a safe and effective placement for catalytic devices. Further, it is desirable and efficient for a for the amount of heat conveyed into the catalytic converter or a thermoelectric generator from the exhaust gas to be maximized and the waste heat lost to the surroundings to be minimized. Moreover, in the case of a typical catalytic converter, once they have begun, the catalytic reactions taking place are exothermic and can thus excessively heat the outside of the catalytic device housing assembly if not insulated properly. Such heating may pose human risk, such as burning the operator's hands or legs, as well as harm to the surrounding environment, if, for example, the heat causes dry grass to catch fire. These engines, such as small diesel or gasoline internal combustion engines (ICEs), are often found on motorcycles, lawn equipment, and recreational vehicles. Unfortunately, these small engines have generally not been able to benefit from catalytic technologies. In many applications, there is a need for a flexible, yet highly effective method to catalyze and remove the harmful emissions without producing excessive heat generation and transfer to the surrounding structure an/or environment. The ability to reduce noise pollution, as well as prevent injuries or harm due to excess heat is also desirable.

Known catalytic systems do not effectively operate until a threshold operational temperature is reached. During this "light-off" period, substantial particulate and non-particulate pollution is emitted into the atmosphere. Accordingly, it is often desirable to place a catalytic device close to the engine manifold, where exhaust gasses are hottest. In this way, the catalyst may more quickly reach its operational temperature. However, design or safety constraints may limit placement of the catalytic converter to a position spaced away from the manifold. In such a case, known exhaust systems have provided insulation on the inside of the pipe leading from the manifold to the catalytic converter. Again, similar constrains apply to the use of other devices that rely on engine heat for their operation, such as thermoelectric generation and electric power production. This insulation is used to direct heat from the manifold to the catalytic converter, where the converter may more quickly reach operational temperature. Additionally, if the insulated pipe is positioned where there is risk of human contact, the insulation may aid in keeping the exterior surface of the pipe cooler, thus reducing the risk of burn.

One known exhaust pipe insulator uses insulating materials, such as beads, between two layers of metallic tubes to reduce the exterior temperature of the exhaust pipe. The inner metal pipe is used to conduct heat away from its source. Another known insulator system uses a particulate based lining on the exhaust manifold to achieve some degree of thermal insulation and noise attenuation, with fiber mats filling the void spaces and providing cushioning. However, particulate-based systems are relatively non-porous, have limited less surface area, and are not very effective thermal insulators. Still another known insulation system places a particulate-based insulation liner on the exhaust manifold. Yet another known insulator system uses metal fibers in manifold-based noise abatement system for small engines. This system has higher backpressures and the metal fibers have relatively low melting point. Moreover, the metal fibers are incompatible with most catalyst materials and, since they are typically better thermal conductors, they do not provide as much thermal insulation as do the ceramic systems. Yet another insulation system incorporates a coated metallic mesh- or screen-type catalytic device; however, this device is characterized by a relatively low conversion efficiency; stacking multiple screens increases the effective conversion but likewise increases backpressure on the engine. In addition, the system offers little in the area of heat and/or noise insulation. Although these known insulated exhaust systems may offer some assistance in reducing light-off times and improving exhaust gas remediation, increasingly stringent emission standards demand further reductions in light-off time and the addition of known insulation systems alone is simply not enough to provide the requisite emissions reductions. Further, even when using these known insulators, a typical vehicle exhaust system sometimes still has to have both a pre-cat and an under-mount cat, the additions of which consume valuable space; moreover, these converters must be positioned to avoid heat hazards such as risk of burn injuries. In the case of small engines, space limitations are extremely constraining, and catalytic devices with high conversion efficiencies are much needed. Thus, there remains a need for a means of decreasing light off time, reducing noise, decreasing exhaust system surface temperature, and/or otherwise reducing pollutant emissions that does not add substantial size and weight to the exhaust system. The present invention addresses this need.

SUMMARY

Briefly, the present invention provides an engine system with a conduit portion for directing the flow of a contaminated or 'dirty' fluid from the engine. The conduit portion defines an inner surface and an outer surface. A substantially fibrous porous nonwoven refractory layer is connected to the inner surface of the conduit portion, wherein the substantially fibrous porous nonwoven refractory layer is characterized by a substantially low thermal conductivity and a substantially high surface area.

In a more specific example, an engine exhaust system conduit is provided, including a generally cylindrical outer portion and a generally cylindrical inner portion. The inner portion is disposed within the outer portion to define a generally cylindrical fluid-flow path. The generally cylindrical inner portion further includes a substantially fibrous porous nonwoven refractory monolith and a catalyst material at least partially coating the monolith.

Advantageously, the flow of exhaust gas may be directed from the engine through an exhaust gas pathway extending between the engine and the atmosphere. The passageway may include a manifold portion fluidically connected to an engine, a muffler and/or catalytic converter and/or thermoelectric generator portion fluidically connected to the atmosphere, a conduit portion fluidically connected between the manifold portion and the muffler and/or catalytic converter and/or thermoelectric generator portion, and/or a plurality of baffles operationally connected within the muffler. A substantially fibrous porous nonwoven refractory material at least partially coats the exhaust gas pathway, wherein exhaust gas from the engine flowing through the exhaust gas pathway to the atmosphere flows over the substantially fibrous porous nonwoven material. The substantially fibrous porous nonwoven material may further be at least partially coated with washcoat and/or catalyst for converting exhaust stream pollutants into non-pollutant gasses. In general, the substantially fibrous porous nonwoven material forms the inner coating of a fluid-flow pathway such that the fluid is able to interact with the substantially fibrous porous nonwoven material and also interact with any chemically active, reactive or catalytic material present on the surface of the fibers. While the specific examples recited herein relate primarily to internal combustion engines, it will be apparent to practitioners in the art that the described methods and apparati may likewise be applied to any system where a conduit is formed to transfer fluids from one location to the other, where reactions take place to convert certain species present in the flowing fluid, and/or where the management of heat, fluid-flow, fluid-dynamics and interaction between fluid and the substantially fibrous porous nonwoven material is advantageous for reaction and/or insulation.

These and other features of the present invention will become apparent from a reading of the following description, and may be realized by means of the instrumentalities and combinations particularly pointed out in the appended claims.

DESCRIPTION OF THE DRAWINGS

The drawings constitute a part of this specification and include exemplary embodiments of the invention, which may be embodied in various forms. It is to be understood that in some instances various aspects of the invention may be shown exaggerated or enlarged to facilitate an understanding of the invention.

DETAILED DESCRIPTION

Figure 1:
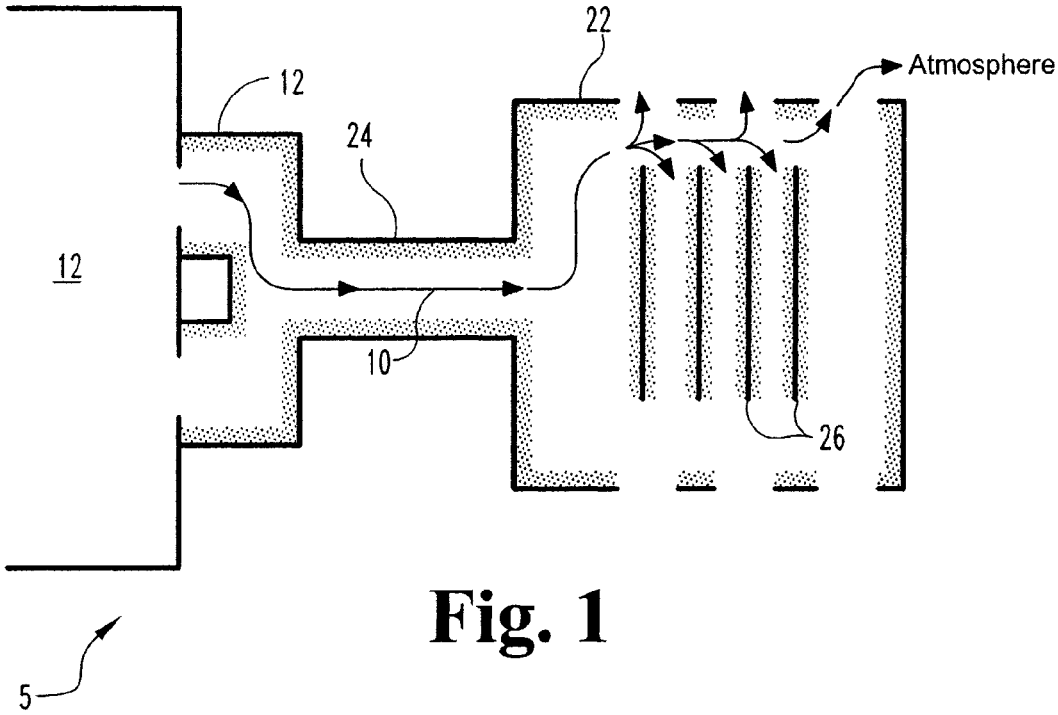
FIG. 1 is a cross-sectional view of a manifold, pipe, and muffler in accordance with the present invention.

Detailed descriptions of examples of the invention are provided herein. It is to be understood, however, that the present invention may be exemplified in various forms. Therefore, the specific details disclosed herein are not to be interpreted as limiting, but rather as a representative basis for teaching one skilled in the art how to employ the present invention in virtually any detailed system, structure, or manner.

The drawing figures herein illustrate and refer to an exhaust system pathway 10 that is specifically described as a component of an internal combustion engine 12 exhaust system. However, it should be appreciated that exhaust pathway 10 may be used on other types of fluid flow systems. For example, the fluid-flow system may be utilized for heat insulation or catalytic conversion for the petrochemical, biomedical, chemical processing, painting shops, laundromat, industrial exhaust, hot-gas filtration, power generation plant, or commercial kitchen applications.

Heat is conducted in a body via three different and distinct mechanisms, conduction, convection and radiation. Conduction in a solid, a liquid, or a gas is the movement of heat through a material by the transfer of kinetic energy between atoms or molecules. Convection in a gas or a liquid arises from the bulk movement of fluid caused by the tendency for hot areas to rise due to their lower density. Radiation is the dissemination of electromagnetic energy from a source and is the only mechanism not requiring any intervening medium; in fact, radiation occurs most efficiently through a vacuum. Generally, all three mechanisms work simultaneously, combining to produce the overall heat transfer effect. The thermal conductivity of a material is a physical property that describes its ability to transfer heat. In order to maximize insulation, the insulator is desired to be capable of reducing all modes of heat transfer. The system 5 described herein includes the ability to provide insulation, and hence more effective transfer of heat to the location where it can be utilized usefully, such as in catalytic conversion.

A catalytic device or converter here refers to a solid structure having catalytic activity. The solid structure may be enclosed in a housing, i.e. a metal can or a metal tube, or another attachment. In general, a catalytic device consists of a host or a structural substrate support, and a catalyst that coats the support. The device may include other components, such as washcoats, modifiers, surface enhancing agents, stabilizers, and the like. A catalytic device contains the appropriate type and mass of support and catalyst so that it can fulfill a precise catalytic function. For example, it may perform a conversion function. The conversion can be of gases into other gaseous products, liquids into other liquids, liquids into gaseous products, gasses into liquid products, solids into liquids, solids into gaseous products or any combination of these specific conversions. In all cases, the conversion reaction or reactions are deliberate and well-defined in the context of a particular application, e.g. the simultaneous conversion of NOx, HC, CO (such as occurs in 3-way converters), conversion of CO to CO2 , conversion of reactive organic component in soot particulates to CO2, conversion of MTBE to CO2 and steam, soot to CO2 and steam, etc.

FIGS. 1-3 illustrate a first embodiment of the present invention, an exhaust system 5 with an exhaust gas apparatus or pathway 10 extending between an engine 12 and the atmosphere with a substantially fibrous porous nonwoven refractory material layer 14 at least partially coating the exhaust gas pathway 10. As shown in FIG. 1, the pathway 10 is typically made up of exhaust system elements such as a manifold portion 20 fluidically connected to the engine 12, a muffler portion 22 fluidically connected to the atmosphere, and a conduit portion 24 fluidically connected between the manifold portion 20 and the muffler portion 22. The muffler portion 22 may further include one or a plurality of baffles 26 operationally connected therein. Such a pathway 10 might typically be found in an automobile exhaust system.

The respective portions 20, 22, 24, 26 of the exhaust gas pathway are typically made of metal, such as iron, stainless steel, aluminum, tin, alloy or the like and thus exhibit "metallic" thermal conductivity behavior. In other words, the metallic components 20, 22, 24, 26 are good conductors of heat. The substantially fibrous porous nonwoven refractory material layer 14, in contrast, is typically made of a fibrous refractory material that is more typically mostly or completely composed of ceramic fibers. Thus, the substantially fibrous porous nonwoven refractory material layer 14 has a relatively low thermal conductivity (although it may have a relatively high heat capacity) and functions as an insulator to prevent heat from escaping through the respective portions 20, 22, 24, 26 of the exhaust gas pathway and instead be retained in the system 5 to more quickly raise the temperature of the catalyst located on the substantially fibrous porous nonwoven refractory material layer 14 or further downstream on another catalytic converter device. Alternately, the exhaust pathway components 20, 22, 24, 26 may be made of non-metallic structural materials, such as ceramics, ceramic composites, plastics or the like. These materials may have relatively high or low thermal conductivities. In either case, the substantially fibrous porous nonwoven refractory material layer portion 14 still functions as a thermal insulator to redirect heat away from the pathway 10 and to the catalyst. Further, the insulating effects of the substantially fibrous porous nonwoven refractory material layer 14 may make it possible to make the components 20, 22, 24, 26 out of materials having lower thermal conductivities and/or lower melting points than otherwise possible, thus broadening the field of materials possible for the construction of the exhaust pathway 10. The substantially fibrous porous nonwoven refractory material layer 14 typically prevents a substantial amount of reactive exhaust gas condensates and components from reaching the surfaces of components 20, 22, 24, 26 defining the exhaust pathway 10, hence reducing the likelihood of failure due to chemical stress on the shell materials.

Figure 2A:
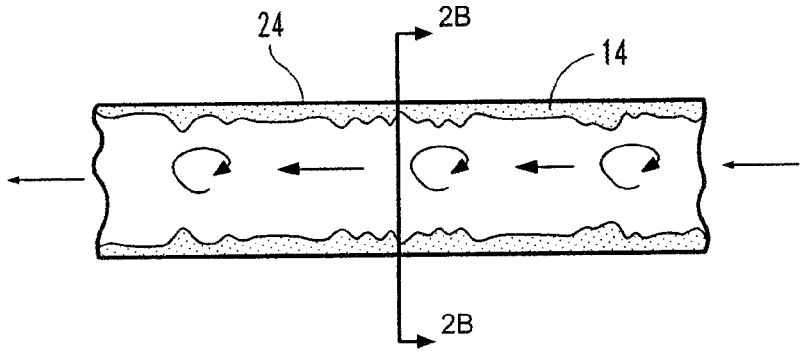
FIG. 2A is a cross-sectional view of an exhaust system conduit component of FIG. 1
Figure 2B:
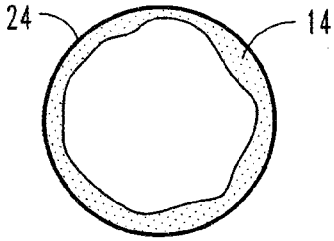
FIG. 2B is a side-sectional view of FIG. 2B.
Figure 2C:
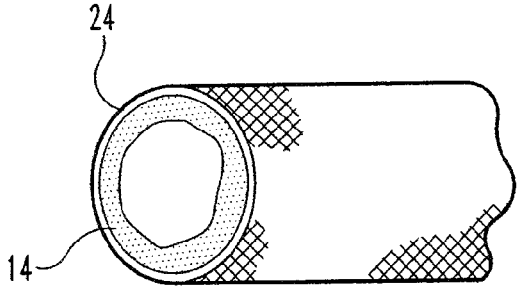
FIG. 2C is a perspective view of FIG. 2A.
Figure 2D:
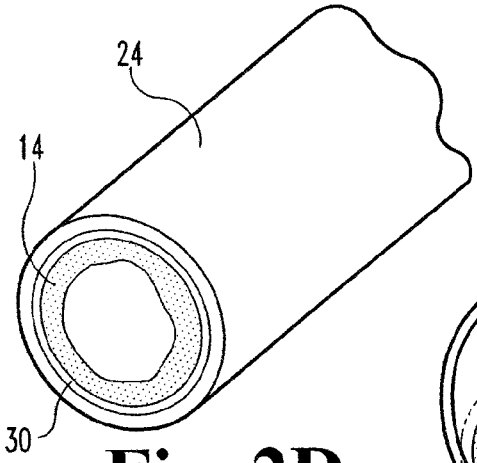
FIG. 2D is a perspective view of FIG. 2C with an adhesive layer between the conduit and fibrous insert layer.
Figure 2E:
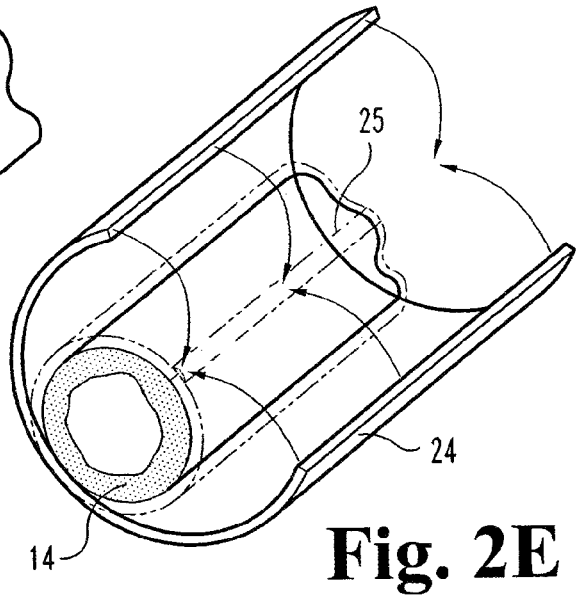
FIG. 2E is a schematic view of FIG. 2C showing the outer tube being wrapped around the ceramic inner core.
Figure 3A:
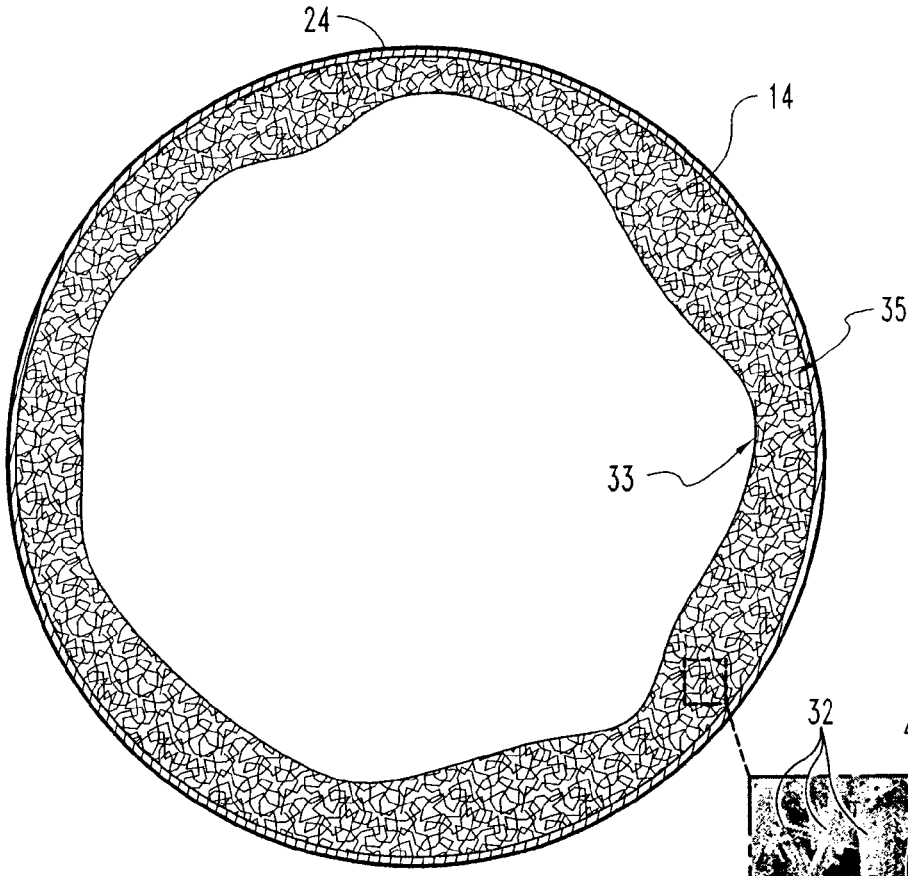
FIG. 3A is a cross-sectional view of an exhaust system component in accordance with the present invention.

Referring to FIGS. 2A-2D, an exhaust system conduit portion 24 is shown with a substantially fibrous porous nonwoven refractory material layer portion 14 connected therein. Typically, both the exhaust system conduit portion 24 and the substantially fibrous porous nonwoven refractory material layer portion 14 are generally cylindrical. The substantially fibrous porous nonwoven refractory material layer portion 14 may be deposited onto the interior of the conduit 24 by such familiar processing techniques as dipping, spraying, casting, or extrusion thereinto. Alternately, the substantially fibrous porous nonwoven refractory material layer portion 14 may be separately formed and inserted into the conduit portion 24. In this case, the outer diameter of the (relaxed) substantially fibrous porous nonwoven refractory material layer portion 14 is substantially equal to or slightly greater than the inner diameter of the exhaust system conduit portion 24. The substantially fibrous porous nonwoven refractory material layer portion 14 may be held in place in the conduit portion 24 by frictional forces (such a substantially fibrous porous nonwoven refractory material cylinder 14 is illustrated in FIG. 2C) such as via an interference fit. Alternately, the substantially fibrous porous nonwoven refractory material layer portion 14 may be held in place in the conduit portion 24 by an adhesive or cementitious layer 30 disposed therebetween (see FIG. 2D). Still alternately, the substantially fibrous porous nonwoven refractory material layer portion 14 may be wrapped in a piece of sheet metal that is then welded 25 or otherwise fastened in place to define a conduit portion 24 (see FIG. 2E).

Regardless of the forming and application techniques selected the substantially fibrous porous nonwoven refractory material layer 14 is typically made of a matrix of tangled (non-woven) refractory fibers 32. The fibers are typically chopped to a relatively short length and more typically have diameter to length aspect ratios of between about 1:3 to about 1:500. Typical fiber diameters range from about 1.5 to about 15 microns and greater. Typical fiber lengths range from several microns to about 1-2 centimeters. More typically, a bimodal or multimodal distribution of fiber aspect rations is used to enhance the strength of the substantially fibrous porous nonwoven refractory material layer portion 14. For example, the aspect ratios may peak at about 1:10 and about 1:100. In other words, the layer portion 14 may be made of fibers having a bimodal aspect ratio, with a first mean at a first predetermined aspect ratio, and a second mean at a second predetermined aspect ratio.

Figure 3B:
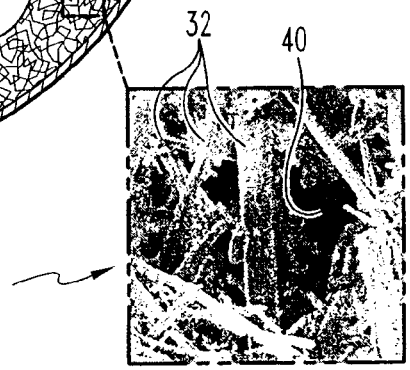
FIG. 3B is an enlarged perspective view of a portion of FIG. 2A showing the fibers in greater detail.
Figure 3C:
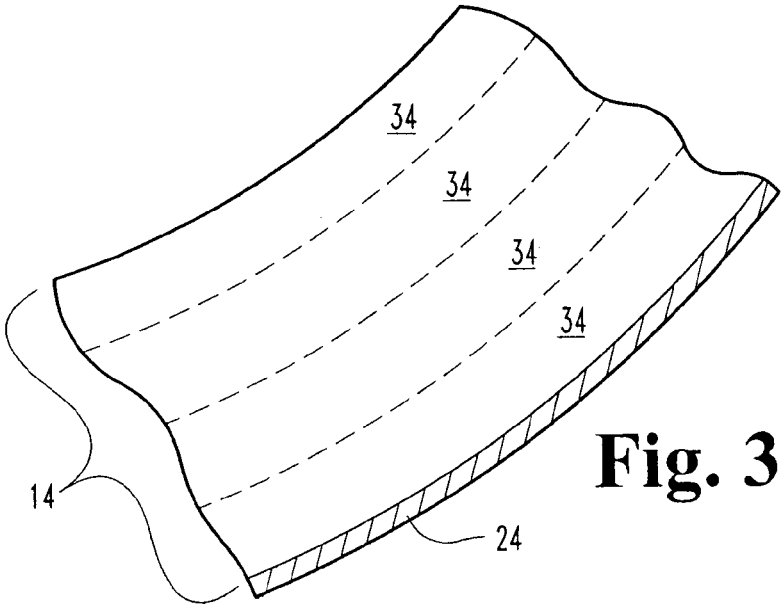
FIG. 3C is an illustration of a portion of FIG. 2A in greater detail.

As shown in FIG. 3B, the fibers 32 are typically refractory, are more typically metal, metal oxide, metal carbide and/or metal nitride, and are still more typically made of one or more of the following materials: alumina, silica, mullite, alumina-silica, aluminoborosilicate, mixtures of alumina and silica, alumina enhanced thermal barrier ("AETB") material (made from aluminoborosilicate fibers, silica fibers, and alumina fibers), zirconia, aluminum titanate, titania, yttrium aluminum garnet (YAG), aluminoborosilicate, alumina-zirconia, alumina-silica-zirconia, magnesium silicate, magnesium aluminosilicate, sodium zirconia phosphate, silicon carbide, silicon nitride, iron-chromium alloys, iron-nickel alloys, stainless steel, mixtures of the same, and the like. For example, fibers 32 made from components of AETB are attractive since AETB composite has a high melting point, low heat conductance, low coefficient of thermal expansion, the ability to withstand substantial thermal and vibrational shock, low density, and very high porosity and permeability. Alternately, the substantially fibrous porous nonwoven refractory material 14 comprises ceramic fibers 32 having amorphous, vitreous, vitreous-crystalline, crystalline, metallic, toughened unipiece fibrous insulation (TUFI) and/or reaction cured glass (RCG) coatings. Still alternately, the substantially fibrous porous nonwoven refractory material 14 comprises Fibrous Refractory Ceramic Insulation (FRCI) material. The refractory fibers 32 may be amorphous, vitreous, partially crystalline, crystalline or poly crystalline. The substantially fibrous porous nonwoven refractory material 14 may also include non-fibrous materials (in addition to catalysts) added as binders or other compositional modifiers. These include non-fibrous materials added as clays, whiskers, ceramic powders, colloidal and gel materials, vitreous materials, ceramic precursors, and the like. During the forming (typically firing) process, some of the non-fibrous additives bond to the fibers 32 and effectively become fibrous; others remain non-fibrous. Some of the coatings may be placed on the substantially fibrous porous refractory material post-firing in the form of vapor depositions, solutions or slurries.

Example substantially fibrous porous nonwoven refractory material 14 compositions include: (1) 70% silica-28% alumina-2% boria; (2) 80% mullite; 20% bentonite; (3) 90% mullite, 10% kaolinite; (4) 100% aluminoborosilicate; (5) AETB composition; (6) 90% aluminosilicate, 10% silica; (7) 80% mullite fiber, 20% mullite whisker precursors (i.e., alumina and silica). All compositions are expressed in weight percents. The compositions may be present as combinations of individual fibers (i.e., composition (2) may include four alumina fibers 32 for every silica fiber 32) or as homogeneous fibers 32 (i.e., composition 1 may be homogenous fibers 32 of an aluminoborosilicate composition) or as a mixture of fibers and non-fibrous materials such as clays, whiskers, ceramic powders, colloidal ceramics, very high surface area materials (aerogels, fumed silica, microtherm insulation, etc), glass, opacifiers, rigidifiers, pore-modifiers, and the like.

The fibers 32 form a porous matrix and are typically sintered or otherwise bonded together at their intersections. The substantially fibrous porous nonwoven refractory material layer 14 is typically at least about 60% porous, is more typically at least about 80% porous, and is still more typically at least about 90% porous. Alternately, the substantially fibrous porous nonwoven refractory material layer 14 may be formed with a porosity gradient, such that the substantially fibrous porous nonwoven refractory material layer 14 is more porous (or less porous) adjacent the respective pathway component(s) 20, 22, 24, 26 and less porous (or more porous) away from the respective pathway component(s) 20, 22, 24, 26 (i.e., adjacent the flowing exhaust gas stream). (See FIG. 3A). Likewise, the substantially fibrous porous nonwoven refractory material layer 14 may have a uniform and typically low density or, alternately, may have a density gradient such that it is denser adjacent the respective pathway component(s) 20, 22, 24, 26 and less dense away from the respective pathway component(s) 20, 22, 24, 26. This may be accomplished by varying the density and porosity of a single fibrous porous nonwoven refractory material layer 14 composition, or, alternately, by forming a fibrous porous nonwoven refractory material layer 14 from a plurality of sublayers 34, wherein each sublayer 34 is characterized by fibers of different size, aspect ratio and/or density (see FIG. 3C) or by applying a densifying coating such as aluminosilicate glass (typically with alkaline or alkaline earth fluxes), borosilicate glass, yttria-alumina-silicate glass, aluminaborosilicate glass, clay suspensions, ceramic suspensions, ceramic powders and precursors with foaming agents (such as azodicarbamides), whiskers, or the like.

Typically, the substantially fibrous porous nonwoven refractory material 14 is selected such that its coefficient of thermal expansion (CTE) is similar to that of the pathway component 20, 22, 24, 26 material to which it is to be connected. This CTE matching is desirable but not critical, since the substantially fibrous porous nonwoven refractory material 14 is fibrous and highly porous, such that there is some 'give' built into the material 14. In other words, compressive forces will first cause the material 14 to deform and not crack or fail.

In one embodiment, the system 5 minimizes conductive heat transfer from the typically relatively hot inner surface 33 to the typically cooler outer surface 35 of the substantially fibrous porous nonwoven refractory material layer 14 through the establishment of a porosity and thermal mass gradient in the layer 14. In this embodiment, porosity is defined by substantially closed cell structures. The porosity increases from the inner surface 33 to the outer surface 35 while the thermal mass likewise decreases, yielding an increase in the concentration of closed cells approaching the outer surface 35. The resulting reduction in the number of paths for heat conduction (generally via molecular vibrational energy transfer) thus reduces heat transfer to the outside surface 35 and the conduit portion 24. Alternately, the porosity may be defined by substantially open cell structures and may be made to decrease from the inner surface 33 to the outer surface 35, yielding an decrease in the concentration of open cells and, thus, convection paths as the outer surface 35 is approached. The resulting reduction in gas flow to the outer surface 35, and thus convective/convection-like heat transfer opportunities, thus reduces heat transfer to the outside surface 35 and the conduit portion 24.

Figure 4:
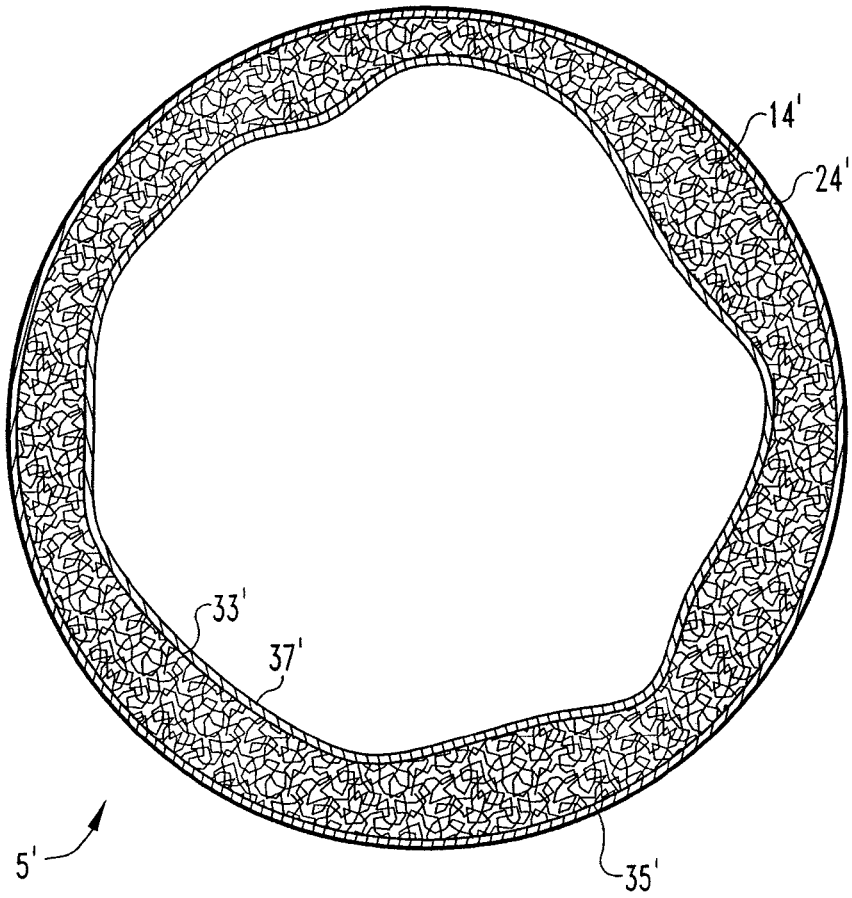
FIG. 4 is a cross-sectional view of an exhaust system component in accordance with a second embodiment of the present invention.

In another embodiment, convective heat transfer through the system 5' from the relatively hot inner surface 33' to the relatively cold outer surface 35' of the substantially fibrous porous nonwoven refractory material layer 14' is minimized by the application of a semi-permeable layer 37' on the inside surface 33'. (See FIG. 4). The semi-permeable layer 37' is typically vitreous, such as a glass matrix layer. The semi-permeable layer 37' typically forms a fiber reinforced glass ceramic matrix composite that retards the penetration of gases into the insulation layer 14', and hence reduces heat transfer to the outside surface 35' and thus prevents excessive heating of the conduit portion 24'.

Figure 5:
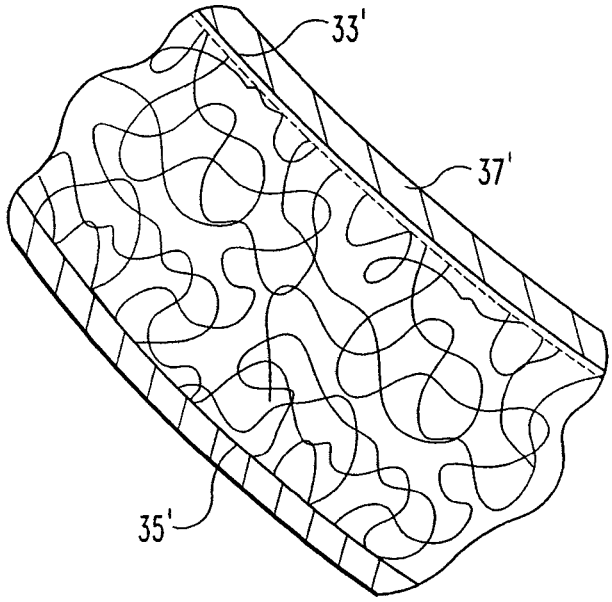
FIG. 5 is a cross-sectional view of an exhaust system component in accordance with a third embodiment of the present invention.

In still another embodiment, a suspension or slurry of crushed borosilicate glass is sprayed onto the inner surface 33". (See FIG. 5). Typically, the crushed glass contains about 6 percent boron content and the particles are on the order of about 1 micron across. Typically, the suspension or slurry may contain about 70% borosilicate glass frit (such as 7930 thirst glass frit available from Corning glassworks), about 30% $MoSi_2$, and 2 or 3% $SiB_6$ in a liquid medium, such as ethanol, with the $MoSi_2$ and $SiB_6$ additives present to enhance emissivity. The slurry is sprayed onto the inside surface 33" to form a coating about 2500 microns thick. The liquid medium is evaporated to yield a layer of powdered materials embedded into the fibrous matrix 14". The fibrous matrix 14" is then heated sufficiently to yield a semi-permeable fiber-reinforced glass ceramic matrix composite layer 37" thereupon. Typically, heating to 2250 degrees Fahrenheit for about 2 hours is sufficient to form the layer 37". The permeability of the coating 37" may be controlled by adjusting the concentration of the slurry constituents, the thickness of the coating, and the firing time/temperature. Alternately, a suspension or slurry of other high temperature glass frits, crushed to finely grained powder, or ceramic precursors clays may be sprayed onto the inner surface 33" to reduce porosity, increase strength and rigidity, enhance durability and to form closed pores.

Figure 6:
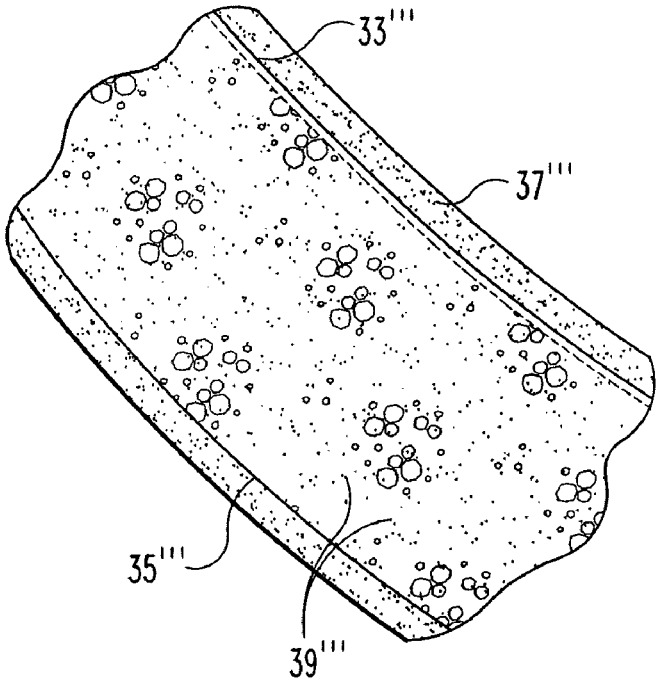
FIG. 6 is a cross-sectional view of an exhaust system component in accordance with a third embodiment of the present invention.

In yet another embodiment, radiative heat transfer from the hot inner surface 33''' to the cold outer surface 35''' is minimized by the addition of thermally stable opacifiers 39''' into the substantially fibrous porous nonwoven refractory material layer 14'''. (See FIG. 6). The particle size distribution of the opacificers 39''' is typically controlled to optimize the distribution thereof throughout the layer 14''' and/or surface coating 37'''. Typically, the opacifiers 39''' are metal oxides, carbides or the like. The particle diameter is typically sized to be about the same as the wavelength of the incident radiation. The opacifier particles 39''' operate to scatter infrared radiation and thus retard transmission. Addition of opacifiers 39''' such as SiC, SiB4, SiB6 and the like into the substantially fibrous porous nonwoven refractory material layer 14''' increase the emissivity of the substantially fibrous porous nonwoven refractory material and of any surface coating 37''' that may be present. Addition of about 2% SiC in the substantially fibrous porous nonwoven refractory material 14''' increases its emissivity to about 0.7.

In the above embodiments, some of the pores, such as the pores on the top surface of the substantially fibrous porous nonwoven material, may be closed or filled by the impregnation or inclusion of non-porous material introduced by means of slurries composed including powders, glass, glass-ceramic, ceramics, ceramic precursors, ceramic foams, colloidals, clays, nano-clays or the like suspended therein. Upon heat treatment, such materials enable the formation of partially or fully closed pores in the surface layers, similar to the closed cell porosity commonly observed in dense ceramics or ceramic foams. The closed pore structure prevents hot fluid from flowing therethrough and thus reduces the amount of heat transferred via convection. The entrapped air also serves as a relatively efficient thermal insulator. The closing of the pores can also be achieved by such alternative methods as, casting, impregnation, infiltration, chemical vapor deposition, chemical vapor infiltration, physical vapor deposition, physical adsorption, chemical adsorption and the like.

Referring back to FIG. 3B, the fibrous porous nonwoven refractory material layer 14 typically includes a catalyst material 36 at least partially coated thereon, typically coating at least portions of the individual fibers 32. The catalyst material 36 is typically chosen from the noble metals, such as platinum, palladium, and rhodium (either alone or as alloys or combinations), and oxides thereof, but may also be selected from chromium, nickel, rhenium, ruthenium, cerium, titanium, silver, osmium, iridium, vanadium, gold, binary oxides of palladium and rate earth metals, transition metals and/or oxides thereof, rare-earth metal oxides (including, for example, $Sm_4PdO_7$, $Nd_4PdO_7$, $Pr_4PdO_7$, La4 $PdO_7$ and the like), and the like. The catalyst is typically a material that lowers the potential barrier for a chemical reaction, such as the conversion of a pollutant species to a to nonpollutant species (i.e., helping the reaction to occur faster and/or at lower temperatures). In general, a catalyst may be used to more readily convert one species to another species at a lower temperature or at a faster rate. Since different catalysts 36 require different threshold temperatures to begin to function, the fibrous porous nonwoven refractory material layer 14 may include more than one catalyst material 36 coated thereupon (either in discrete regions or intermixed with one and other). For example, the fibrous porous nonwoven refractory material layer 14 may include a first catalyst material 36 that begins to function at a first, relatively low temperature and a second catalyst material 36 that activates at a second, higher temperature. The second material 36 may be added because it is cheaper, more chemically and/or thermally stable, has a higher top end temperature for catalyst function, and/or is a more efficient catalyst 36. Additionally multiple catalysts may also be utilized to assist in catalytic reactions of different species. Typically, a washcoat layer 38, such as alumina, ceria, zirconia, titania or the like, is provided between the fibers 32 and the catalyst material 36 to promote adhesion and to increase the overall surface area available for chemical reactions. Both the layer 14 thickness and degree of catalyst 36 coating on the fibers 32 may be increased and/or decreased to tailor the temperature (i.e., the degree of thermal insulation provided) and catalytic activity (catalyst 36 is expensive, and thus it is desirable to not use more than is necessary for a given exhaust gas environment) of the exhaust system. The system 5 allows catalytic benefits coincident with temperature management to increase vehicle/equipment safety (by lowering exhaust system outer temperature), shorten light-off time, utilize otherwise wasted heat, and the like while simultaneously decreasing pollution emissions. The system 5 may be used in tandem with conventional and pre-existing pollution control methodology, or may be used alone to address pollution emissions from heretofore uncontrolled sources, such as lawn mowers. As there are fewer components in the exhaust pathway 10, the complexity of the typical vehicular exhaust system may be reduced while the weight thereof is decreased; backpressure and cost may both be simultaneously reduced as well.

In operation, exhaust gas from the engine 12 typically flows through the exhaust gas pathway 10 to the atmosphere and also flows through the substantially fibrous porous nonwoven refractory material layer 14 positioned therein. Baffles 26 operate to make the gas flow more turbulent, as a tortuous flow path, along with high catalyst surface area, serves to increase catalytic efficiency of the system 5. Since the fibrous nonwoven refractory material layer 14 is typically substantially porous, the diffusion forces urge the exhaust gas into the pores 40 of the substantially fibrous porous nonwoven refractory material layer 14. The fibrous nonwoven refractory material layer 14 is typically thick enough to provide substantial thermal insulation to the pathway 10, but not so thick so as to significantly impeded the flow of exhaust fluids from the engine 12 to the atmosphere and thus contribute to an unacceptable build-up of back pressure. Typically, the fibrous nonwoven refractory material layer 14 is between about 1 and about 3 centimeters thick, although the thickness may vary with exhaust system size, positioning in the pathway 10, and the like. For instance, it may be desirable for the fibrous nonwoven refractory material layer 14 to be thicker adjacent portions of the pathway 10 more prone to operator contact (such as near the foot plate on a motorcycle exhaust system 5) to prevent burn injuries. Alternately, the fibrous nonwoven refractory material layer 14 may be made thinner near the engine 12, such as in the manifold portion 20, such that the catalyst material 36 thereon reaches light-off temperature sooner, thus beginning to convert pollutants to non-pollutants sooner.

Typically, the exhaust gas does not penetrate completely into the substantially fibrous porous nonwoven refractory material layer 14, since the diffusion forces are relatively weak as compared to the pressure differential between the engine and the atmosphere that urges the exhaust gas along and out of the pathway 10 and into the atmosphere. The substantially fibrous porous nonwoven refractory material layer 14 also tends to become denser and less porous moving from its inner surface (adjacent the exhaust gas) to its outer surface (adjacent the manifold 20, muffler 22, conduit 24, etc. . . . portions of the exhaust gas pathway 10), further retarding the penetration of gas therethrough.

The exhaust gas transfers heat into the substantially fibrous porous nonwoven refractory material layer 14, which tends to quickly raise the temperature of (at least the inner surface of) the layer 14 until it is in equilibrium with the exhaust gas temperature, since the substantially fibrous porous nonwoven refractory material layer 14 typically has a low thermal conductivity value and, more typically, a low thermal mass. If a catalyst 36 material is present thereon, its temperature is likewise quickly increased into its operating range, whereupon the catalyst material 36 begins to convert pollutants in the exhaust gas into relatively harmless nonpollutant gasses.

The system 5 may be used with any source of pollutant fluids, such as gasoline and diesel engines, including those in automobiles, motorcycles, lawn mowers, recreational equipment, power tools, chemical plants, power-generators, power-generation plants, and the like, to further reduce pollution emissions therefrom. Further, the system 5 provides an additional function of trapping particulate emissions in fibrous nonwoven refractory material layer 14 for later burn-out or removal. The system may be present in the form of a ceramic insert 14 into an existing exhaust system 24 component (see FIG. 2C), an add-on internally coated 14 pipe 24 having couplings or connectors 42 operationally connected at one or both ends (see FIG. 7), as a replacement segment or portion (i.e., conduit 24, muffler 22, etc. . . . ) to an existing exhaust system having an inner insulator layer 14 for treating exhaust gasses, or as an exhaust system 5 as originally installed.

Figure 7:
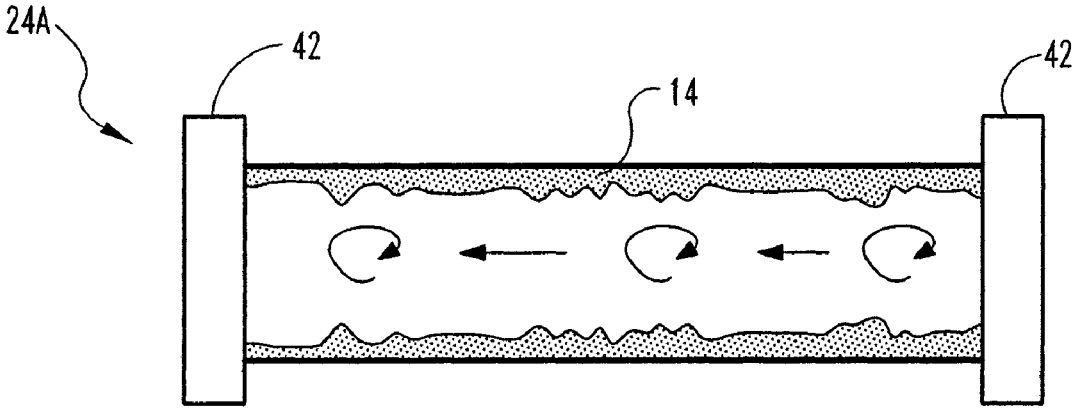
FIG. 7 is a cross-sectional view of an exhaust system component in accordance with a fourth embodiment of the present invention.

Referring more particularly to FIG. 7, a replacement conduit portion 24A is provided with regards to aftermarket modification of pre-existing exhaust systems. The replacement conduit portion 24A includes an inner fibrous nonwoven refractory material layer 14 attached thereto or formed therein and terminates at either end in a connector fitting 42. In use, the replacement conduit portion 24A is connected to an existing exhaust system by cutting into the exhaust system and removing a portion thereof of about the same length as the replacement conduit portion 24A. The two thus-formed newly-cut exposed ends of the exhaust system are connected to the respective connector fittings 42, such as by welding, to replace the cut out and removed original portion of the exhaust system with the replacement portion 24A. Exhaust gasses flowing through the replacement portion 24A will, at least in part, flow through the fibrous nonwoven refractory material layer 14 and thus at least some of the particulate matter therein will be filtered out. Further, if the fibrous nonwoven refractory material layer 14 supports catalyst material 36 on the fibers, certain exhaust gas species may be catalytically converted into other, more desirable species.

The system 5 is typically used in conjunction with other pollution reduction systems (such as in automobiles) to further reduce pollutant emissions, but may also be used alone where space is at a premium (such as in lawn mowers, hand-held motor-powered equipment, or the like).

Figure 8:
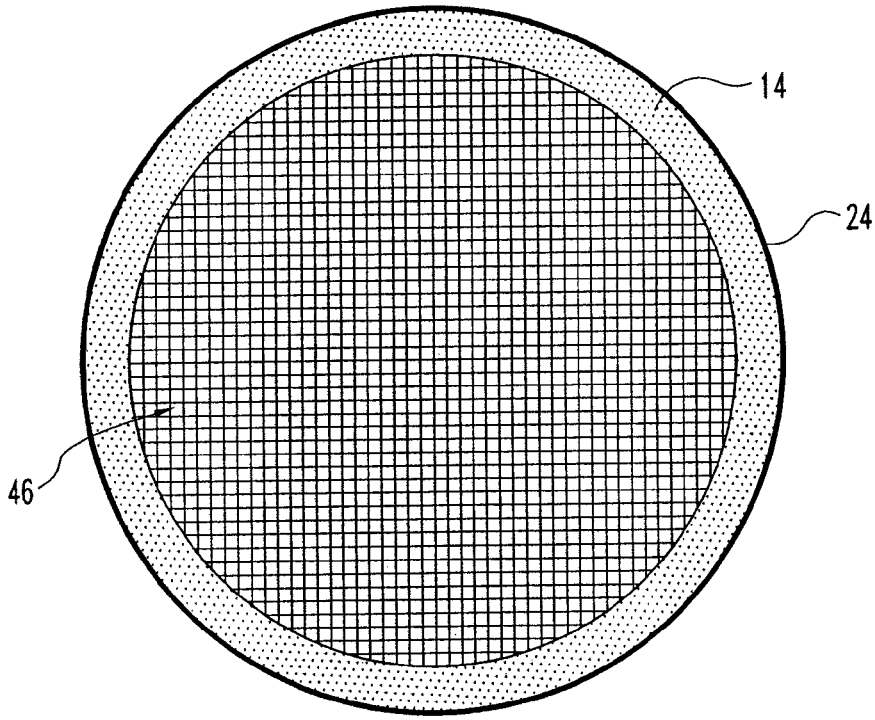
FIG. 8 is a cross-sectional view of an exhaust system conduit component supporting a catalytic converter device within in accordance with the present invention.

The insulation layer 14 thus accomplishes two functions that, on the surface, may appear different and somewhat opposing, namely quickly heating the catalyst material 36 in (both in the insulation layer 14, if present and in a separate catalytic converter device 46 that may be positioned in the system) and keeping the outer surface of the exhaust pathway 10 cool. (See FIG. 8). First, the inside surfaces of the insulation layer 14 (i.e., the surface that interfaces with exhaust gas) capture heat to raise the temperature of the catalyst material 36 residing on the fibers 32 to quickly reach an operational temperature. These inside regions are therefore relatively less porous, with smaller pore-sizes and a high surface area contributed by exposed fibers 32. The regions approaching and adjacent the outside wall 10 prevent or retard the flow of heat therethrough, and thus are typically relatively more porous with larger pore sizes to trap dead air. The large amount of trapped, noncirculating air near the wall 10 thus provides good thermal insulation. In some cases, the use of large sized pore-formers (such as organic particulates with sizes greater than 50 micron and, more typically, between about 100-200 microns) will result in a pore structure that roughly resembles a foam. In such cases, a substantially fibrous refractory foam-like body is formed having air is entrapped to provide a higher degree of thermal insulation. Heat is prevented from leaving the exhaust system 5 through the pathway 10 is thus present to raise the temperature of the catalyst 36 and eventually is eliminated from the system 5 via heated exhaust gasses escaping into the atmosphere.

The insulation layer 14 may be formed through a variety of means. For example, the substantially fibrous porous nonwoven refractory material layer 14 may be disposed upon a exhaust gas pathway surface 10 through such ceramic processing techniques as extrusion, molding, coating, spraying, tape casting, sol-gel application, vacuum forming, or the like. Alternately, the substantially fibrous porous nonwoven refractory material 14 may be applied on flat metal and then roll into a pipe 24. Still alternately, the inner fibrous layer 14 may be cast and then the external housing 10 formed therearound. Yet alternately, the inner fibrous layer 14 may be formed as a tube for insertion into an existing external exhaust pathway 10 portion, such as a pipe 24.

Figure 9:
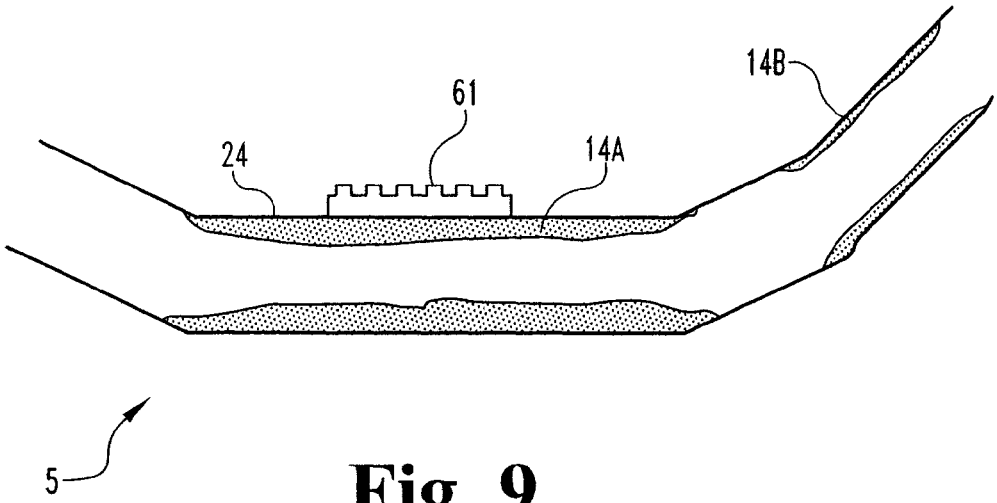
FIG. 9 is a cross-sectional view of an exhaust system component in accordance with a fifth embodiment of the present invention.

Likewise, the layer 14 may be formed to varying degrees of thickness. For example, the layer 14 may be formed as a thick, porous membrane. Alternately, the layer 14 may be made sufficiently thick so as to have more significant sound and thermal insulative properties. (See FIG. 9). In this illustration, the exhaust system 5 is connected to a motorcycle. A thicker insulating layer 14A is positioned within the conduit portion 24 of the exhaust system 5 proximate a foot rest, such that the foot rest 61 (and, presumably, a rider's foot) will benefit from the lower conduit temperatures provided by the increased thermal insulation. A thinner layer 14B is provided elsewhere within the system 5. Additionally, the layer 14 may be formed relatively thickly on baffles 26 to improve catalytic efficiency and noise attenuation (see FIG. 1).

While the invention has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the invention are desired to be protected.

What is claimed is:

1. An insulated exhaust pipe, comprising:

a thermally conducting tube having an inside wall; and a thermally insulating layer disposed on the inside wall of the tube, and defining an exhaust path through the tube;

wherein the thermally insulating layer further comprises:

a substantially fibrous refractory material;

a catalyst at least partially coating the material; and wherein the thermally insulating layer has a higher density close to the inside wall of the tube and a lower density spaced away from the inside wall of the tube.

2. The insulated exhaust pipe of claim 1 wherein the fibrous material is selected from the group consisting of alumina fibers, silica fibers, magnesium silicate fibers, magnesium-aluminosilicate fibers, aluminum titanate fibers, aluminazirconiasilica fibers, sodium zirconia phosphate fiber, aluminosilicate fibers, aluminoborosilicate fibers, n-SIRF-C, AETB, HTB, FRCI, LI, and combinations thereof.

3. The insulated exhaust pipe of claim 1 wherein the thermally insulating layer has a coefficient of thermal expansion substantially matching the coefficient of thermal expansion of the tube.

4. The insulated exhaust pipe of claim 1 wherein the thermally insulating layer comprises fibers having an aspect ratio of between about 1:3 to about 1:500.

5. The insulated exhaust pipe of claim 1 wherein the thermally insulating layer comprises fibers having a bimodal aspect ratio, with a first mean at a first predetermined aspect ratio, and a second mean at a second predetermined aspect ratio.

6. An insulated pipe, comprising:

a conduit portion for directing the flow of a fluid;

a substantially fibrous refractory layer connected to an inner wall of the conduit portion, the substantially fibrous refractory layer comprising;

a highly porous portion;

a first substantially fibrous composite material portion; and a second substantially fibrous composite material portion;

wherein the first substantially fibrous composite material portion has a different density than the second substantially fibrous composite material portion, and wherein the first substantially fibrous composite material portion includes a first catalyst material coated thereupon and wherein the second substantially fibrous composite material portion includes a second catalyst material coated thereupon.

* * * * *